US006401259B1

(12) United States Patent
Epperson et al.

(10) Patent No.: US 6,401,259 B1
(45) Date of Patent: Jun. 11, 2002

(54) CUSTOM FITTING ASSEMBLY FOR HELMET WITH PROTECTIVE HOOD

(75) Inventors: William Lewis Epperson, Clarks Summit; Francis J. Kuna, Carbondale; Robert Henry Nattress, Shavertown, all of PA (US)

(73) Assignee: Gentex Corporation, Carbondale, PA (US)

( * ) Notice: Subject to any disclaimer, the term of this patent is extended or adjusted under 35 U.S.C. 154(b) by 0 days.

(21) Appl. No.: 09/729,119

(22) Filed: Dec. 4, 2000

Related U.S. Application Data

(63) Continuation-in-part of application No. 09/497,032, filed on Feb. 2, 2000, now Pat. No. 6,279,172.

(51) Int. Cl.[7] ..... A42B 1/06

(52) U.S. Cl. ..... 2/410; 2/205; 2/457; 2/901; 128/201.23

(58) Field of Search ..... 2/410, 411, 422, 2/457, 6.1, 6.2, 6.3, 6.6, 6.7, 414, 415, 416, 424, 84, 202, 205, 901, 206; 128/201.23, 206.28, 201.29, 202.11

(56) References Cited

U.S. PATENT DOCUMENTS

| | | | | | |
|---|---|---|---|---|---|
| 2,455,797 | A | * | 12/1948 | Myers | |
| 2,861,568 | A | * | 11/1958 | Quilter et al. | 128/201.23 |
| 2,935,985 | A | * | 5/1960 | Andrews et al. | 128/201.23 |
| 3,055,012 | A | * | 9/1962 | Aileo | 2/205 |
| 3,362,403 | A | * | 1/1968 | Fleming et al. | 128/201.24 |
| 3,594,814 | A | * | 7/1971 | Schuessler et al. | 2/205 |
| 3,843,970 | A | * | 10/1974 | Marietta et al. | 2/415 |
| 4,057,058 | A | | 11/1977 | Kovacevic | |
| 4,172,455 | A | | 10/1979 | Beaussant | |
| 4,173,220 | A | | 11/1979 | Ratz et al. | |
| 4,266,301 | A | | 5/1981 | Canda | |
| 4,352,353 | A | * | 10/1982 | Bolton et al. | |
| 4,622,696 | A | * | 11/1986 | Griffiths | 2/424 |
| 4,702,243 | A | | 10/1987 | Smith | |
| 4,848,330 | A | | 7/1989 | Cowles | |
| 4,890,335 | A | | 1/1990 | Crowson | |
| 4,896,665 | A | | 1/1990 | Gervais | |
| H823 | H | * | 10/1990 | Conkle et al. | 2/205 |
| H863 | H | * | 1/1991 | Kwiedorowicz et al. | 128/201.23 |
| 5,003,973 | A | | 4/1991 | Ford et al. | |
| 5,133,344 | A | | 7/1992 | Jurrius et al. | |
| 5,315,718 | A | * | 5/1994 | Barson et al. | 2/418 |
| 5,526,804 | A | | 6/1996 | Ottestad | |
| 5,572,990 | A | | 11/1996 | Berlin | |
| 5,584,073 | A | * | 12/1996 | Radzelovage et al. | 2/416 |
| 5,895,537 | A | | 4/1999 | Campbell | |
| 5,990,793 | A | | 11/1999 | Bieback | |
| 6,014,971 | A | | 1/2000 | Danisch et al. | |
| 6,016,802 | A | | 1/2000 | Jackson | |

FOREIGN PATENT DOCUMENTS

| | | | |
|---|---|---|---|
| EP | 468675 | * | 1/1992 |
| FR | 2595573 | * | 9/1987 |
| GB | 2047545 | * | 12/1980 |
| GB | 2 247 416 | | 4/1992 |
| WO | 93/14818 | * | 8/1993 |

* cited by examiner

*Primary Examiner*—Rodney M. Lindsey
(74) *Attorney, Agent, or Firm*—Keusey, Tutunjian & Bitetto, P.C.

(57) ABSTRACT

A protective hood molded to the contours of the interior of an aircrew helmet. The brow pad and a support panel are located within the protective hood. The custom fitting system, that adjusts the position of the support panel relative to the helmet, is located outside the hood. The custom fitting system is pivotally connected to the support panel, with the protective hood sealed around the pivotal connection. The brow pad and support panel lift the hood off the wearer's head, providing a gap to circulate ventilating air.

54 Claims, 7 Drawing Sheets

CUSTOM FITTING ASSEMBLY FOR HELMET WITH PROTECTIVE HOOD

CROSS-REFERENCE TO RELATED APPLICATIONS

This is a Continuation-in-part of U.S. patent application Ser. No. 09/497,032 filed Feb. 2, 2000 now U.S. Pat. No. 6,279,172.

BACKGROUND OF THE INVENTION

1. Field of the Invention

The invention relates to a custom fitting assembly for a helmet equipped with a protective hood. The system is particular suited for use with helmet mounted devices which support military air and ground operations.

2. The Prior Art

In general, helmets are designed to meet requirements for comfort, stability, and head impact protection during flight, egress and ejection, and to fit an anthropometric range of heads. With the advent of helmet mounted devices (HMDs) an increased demand for optical stability was required to keep the HMD in the operator's field of view. This created various designs of inner liners and improved suspension systems to meet the comfort, stability and weight bearing requirements of the many HMDs.

Improvements in electro-optics technologies promised to transfer aircraft mounted head up displays and HMD imagery to the inner surface of the helmets visor or to other optical display combiner or device. With new Helmet Mounted Display (HMD) technologies comes a new and even tighter requirement for optical stability. Current helmets have been used to launch these new technologies with little success. The weights and center of gravity of new HMD systems displace the helmet out of the "eyebox" thereby negating the HMD's operational effectiveness as well as causing aircrew fatigue, neck strain, and during ejection possible severe injury and death.

An example of a prior art design is described in U.S. Pat. No. 5,584,073. A serious drawback with such platform is that to achieve a high level of stability, the suspension had to be tightened to the point of wearer discomfort. While the suspension system was tight it still swayed under "G" loading with HMD weights. Due to the narrow headband, the load bearing areas around the head created numerous areas of discomfort, known as "hot spots". Additionally, each HMD system requires exact and repeatable placement of the image in front of the wearer's eyes, which must be maintained during the entire mission and over many missions. Designers concluded that meeting such criteria with existing systems could not be practically achieved and would require an impractical number of helmet sizes to properly fit a large anthropometric head population.

Accordingly, it would be desirable to provide an inner helmet assembly in just a few sizes which could be easily custom-fitted to military personnel for use with various outer helmet systems for a variety of modern combat applications. Such an inner helmet would figuratively lock onto the wearer's head thereby insuring reproducible alignment of the "eyebox" to the eventual HMD.

SUMMARY OF THE INVENTION

It is therefore a primary object of the invention to provide a helmet fitting assembly in one or two sizes with custom-fitted inserts that can be adapted to various helmets.

It is a further object of the present invention to allow easy positioning of the helmet with positive locking devices.

It is yet another object of the present invention to provide an insert which is molded or formed in situ to conform to a portion of the wearer's head.

It is still another object of the present invention to equip the helmet with a hood that provides protection against chemical agents and biological agent, as may occur during chemical or biological warfare or industrial accidents.

These and other related objects are met by providing a semi-rigid suspension system of independent components which contacts the head over large surface areas. The system includes a custom-contoured component and positive lock components which cooperatively allow repeated engagement of the desired design eye position.

The preferred embodiment of the system revolves around an inner helmet comprising a front forehead dome and side sections. A semi-rigid rear panel engages the wearer's nape and has adjusting straps which extend generally forwardly to engage positive locking, clips located on the inner helmet side sections. The inner helmet is positioned in the fore and aft directions by the rear panel adjusting straps. A contoured pad then supports the forehead dome on the user's forehead. The contoured pad includes an inner comfort layer, a primary layer which is custom fitted in situ, and an outer impact absorbing layer. Because the primary layer is essentially a mold of the wearer's forehead it always seats in the same position.

A semi-rigid crown pad has adjusting straps which extend generally downward to engage positive locking clips located on the inner helmet side panels. The inner helmet assembly is suspended from the crown pad via the straps which are adjusted to bring the inner helmet to the desired vertical position. The inner helmet is restricted from upward movement by a chin strap or breathing mask.

The components of the helmet fitting assembly are adjusted along the horizontal and vertical axes to position the wearer's eyes in the proper orientation and distance from the ultimate display. In use the helmet fitting assembly also resists forward rotation caused by the weight of the display systems located in front of the wearer's forehead within the helmet. Forward rotation is characterized by the forehead dome sliding down while the rear portion of the helmet rides up. These forces are resisted by the brow pad which is molded to a particular part of the forehead, the nape panel, and by the chin strap or breathing mask which opposes any tendency of the rear part of the helmet to pivot away from the wearer's chin.

It can be seen that we have met the various objects of the invention by providing a custom molded insert which complements the positive lock components used for alignment. The semi-rigid crown pad and nape panel are strong, lightweight and conformable to individual sizes and shapes. All inserts are designed to distribute weight and stresses over large surface areas avoiding sensitive regions of the head. The inserts work in conjunction with the chin strap or breathing mask and nape strap to resist pivoting forces thereby locking the helmet in its desired position.

BRIEF DESCRIPTION OF THE DRAWINGS

In the accompanying drawings to which reference is made in the instant specification and which are to be read in conjunction therewith and in which like reference numerals are used to indicate like parts in various views.

DETAILED DESCRIPTION OF THE PREFERRED EMBODIMENT

Figure 1:
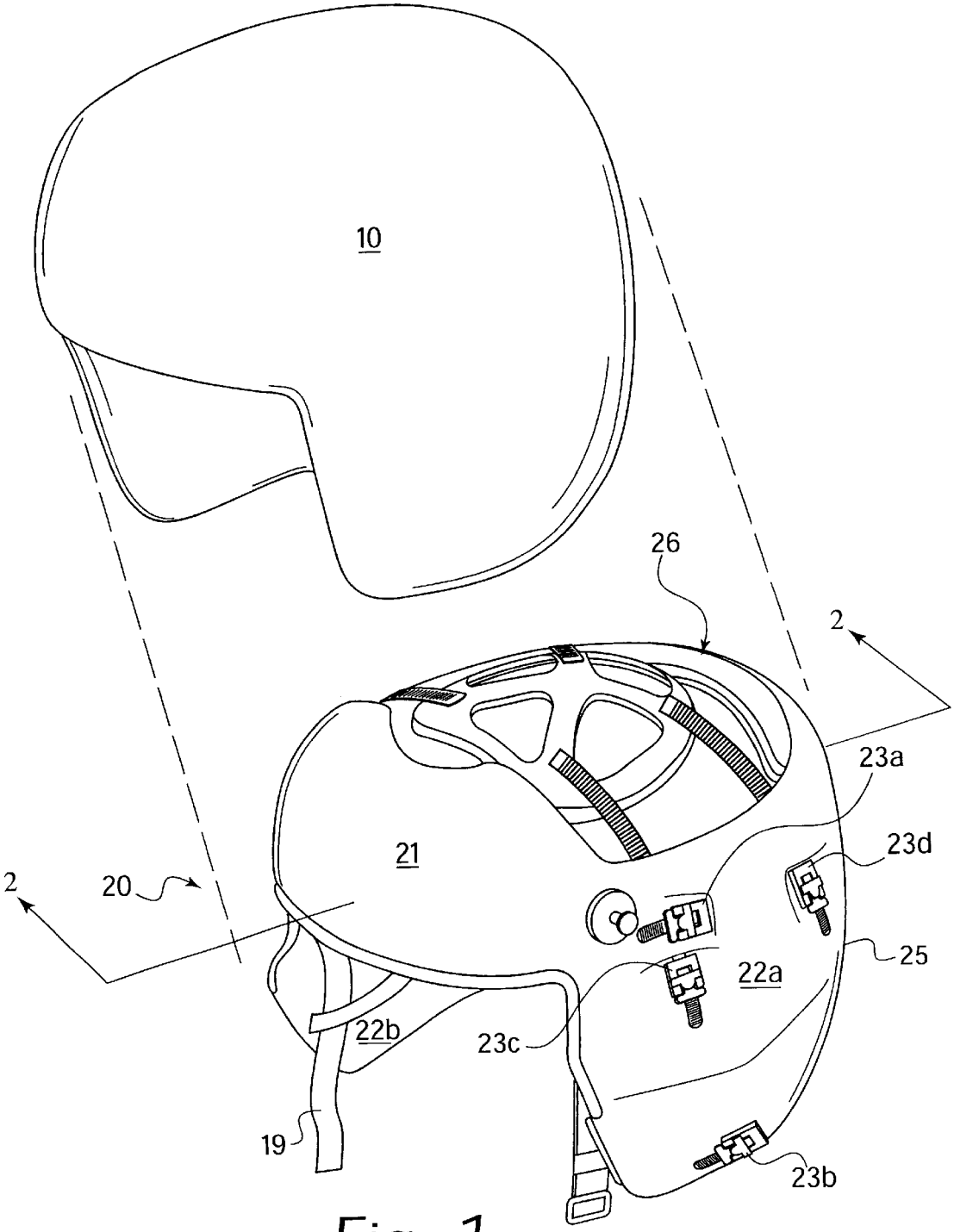
FIG. 1 is an exploded view of the preferred embodiment showing an outer helmet separated from an embodiment of an inner helmet which includes the fitting assembly according to the invention.

Referring now in detail to drawings, and in particular FIG. 1, there is shown an outer helmet 10 separated from an inner helmet 20. Outer helmet 10 may, for example, be formed of ballistic material of any suitable type known to the art to afford the wearer protection against injury from flying fragments and the like. Outer helmet 10 may consist of a basic protective helmet for infantry, a standard helmet for air crew provided with visors, or an advanced helmet for air crew provided with HMD technologies. Inner helmet 20 may be permanently attached within outer helmet 10, for example, by screws or adhesives. Alternatively inner helmet 20 may be clipped, latched or otherwise removable secured within outer helmet 10, for example by an interchangeable latch assembly described in a commonly-owned, copending patent application Ser. No. 09/640,442 filed on Aug. 17, 2000. Total weight for the inner helmet and on HMD equipped outer helmet is in the order of 4½ lbs.

Inner helmet 20 is a rigid frame made of a strong yet lightweight material, for example, graphite or fiberglass. Inner helmet 20 is characterized by a broad forehead dome 21, side sections 22*a* and 22*b*, a rear panel 25 and a crown aperture 26. Side section 22*a* includes a first pair of retention clips 23*a* and 23*b* and a second pair of retention clips 23*c* and 23*d*. A similar set of retention clips are mounted onto side panel 22*b*. A chin strap 19 extends between the lower portions of side panels 22*a* and 22*b*.

Figure 2A:
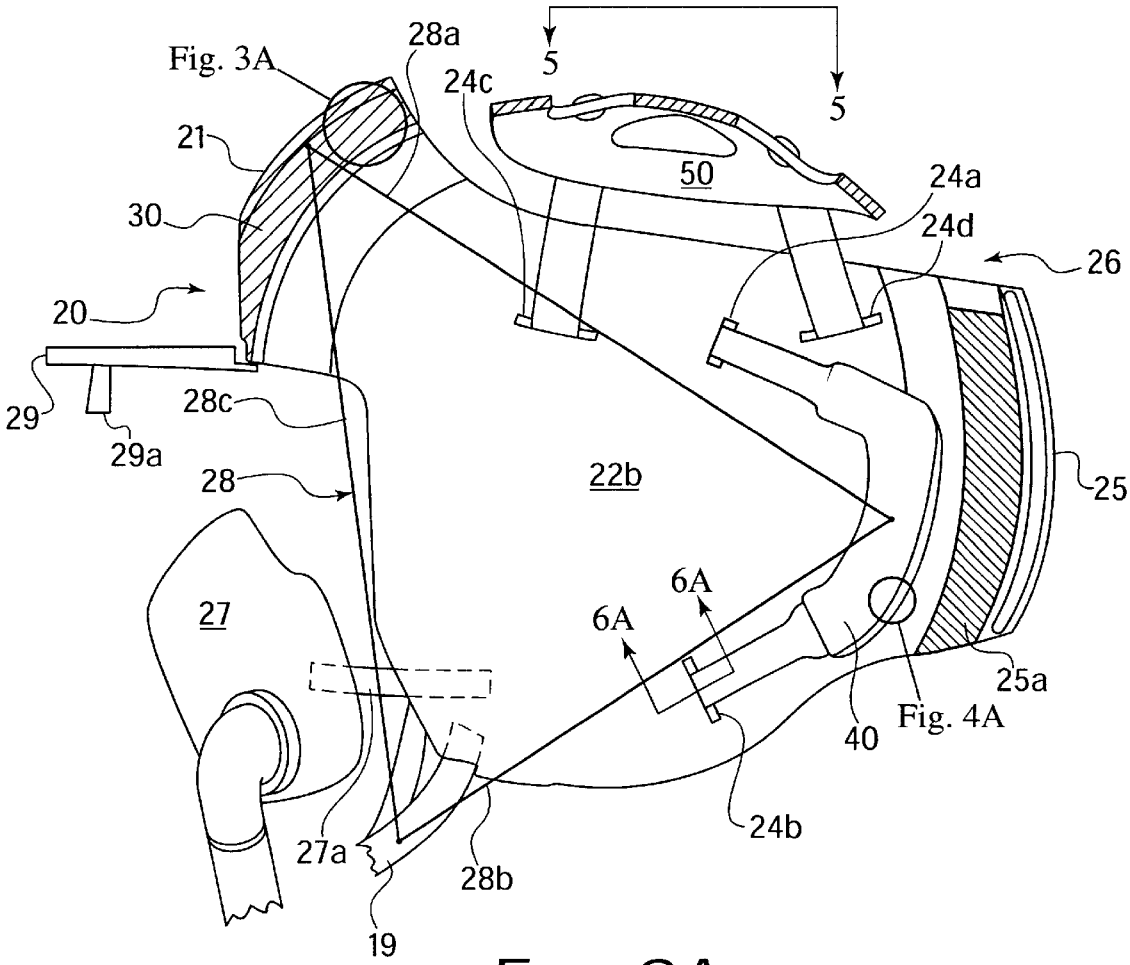
FIG. 2A is a cross-sectional view of the inner helmet taken along the line 2—2 from FIG. 1.

Referring now to FIG. 2A side panel 22*b* is shown with a first pair of side panel slots 24*a* and 24*b* disposed immediately rearwardly of the first pair of retention clips, and a second pair of side panel slots 24*c* and 24*d* disposed immediately above the second pair of retention clips. A crown pad 50, which will be described in greater detail below, includes adjusting straps that extend through slots 24*c* and 24*d* and into respective retention clips. These adjusting straps permit vertical positioning of inner helmet 20 relative to the crown of the wearer's head. A breathing mask may be attached to side panels 22*a* and 22*b* via adjustable length straps 27*a*. While not shown for the sake of clarity, the central portion of each side panel may comprise a depression for accommodating ear phones.

Adjacent the interior of forehead dome 21 is a brow pad 30 which will be discussed in greater detail below in connection with FIGS. 3A and 3B. A rear pad 25*a* of impact absorbing material is attached to the interior of rear panel 25. Interior of rear pad 25*a* is a nape panel 40 which will be discussed in greater detail in connection with FIGS. 4A and 4B. In use, the adjusting straps of nape panel 40 are employed to set the fore and aft position of inner helmet 20 with respect to the nape of the wearer's neck. Brow pad 30 is subsequently fitted to the contours of the wearer's forehead. Points within brow pad 30, nape panel 40 and chin strap 19 or breathing mask 27 form the apices of an imaginary triangle 28. Upon installation of brow pad 30, leg 28*a* of triangle 28 assumes a fixed length. When tightened, chin strap 19 or breathing mask 27 essentially fixes the distance of legs 28*b* and 28*c*. The significance of the fixed triangle geometry is as follows.

The straps of nape panel 40 and crown pad 50 may be adjusted to establish a particular exit pupil distance for an outer helmet mounted display (HMD). The position is retained by brow pad 30 which fills the entire space between forehead dome 21 and the wearer's forehead. An outer helmet mounted display typically adds significant weight to the front portion of the helmet. Such weight is evenly distributed across large surface areas via brow pad 30 and crown pad 50. The moment of this forwardly-mounted weight generally urges forehead dome 21 downwardly over the wearer's eyes. Since leg 28*a* is of a fixed length, such movement would require nape panel 40 to pivot counterclockwise. However, since leg 28*b* is of fixed length the torque applied to nape panel 40 is resisted by chin strap 19.

Figure 2B:
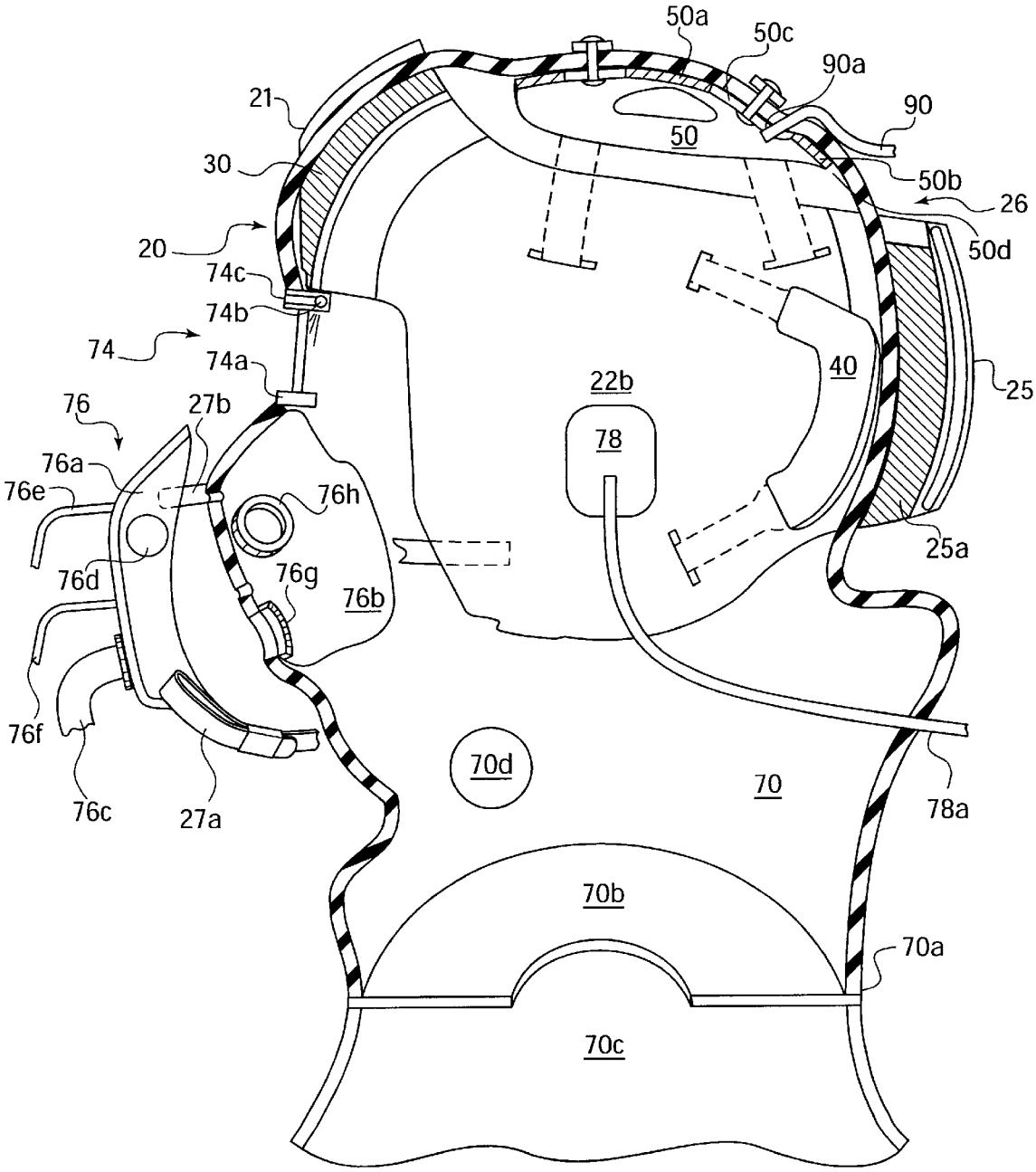
FIG. 2B is a cross-sectional view similar to FIG. 2A showing the protective hood according to the invention.

FIG. 2B is another cross-sectional view showing a protective hood 70 that is completely integrated with the components of the custom fitting assembly. The hood forms a protective bubble around the head. With the introduction of chemically- and biologically-filtered breathing and ventilation air into the hood, aircrew can safely operate, and exit their vehicles, in hostile environments.

FIG. 2B illustrates the positioning of protective hood 70 with respect to the nape panel 40 and crown pad 50, both of which shall be generically referred to as support panels. Brow pad 30 is first fitted and then placed inside hood 70. Nape panel 40 and crown pad 50 are also placed inside hood 70 with their straps located outside hood 70. Hood 70 is sealed around the pivotal connection between the support panels and their straps, as will be described in further detail below. The straps are shown in dotted line indicating that in the view of FIG. 2B they are behind hood 70.

To seal across the open front of the helmet, there is provided a visor 74 having a visor periphery 74*a*. A visor duct 74*b* is disposed within periphery 74*a* and is fed ventilating air through the front or side of visor 74, for example, at a location 74*c* outside the hood. Below the visor is a respiration system 76 having the following conventional components: a stiff outer shell 76*a;* a rubber inner facepiece 76*b;* a breathing air supply hose 76*c;* an exhalation valve 76*d;* a microphone cable 76*e;* a drink tube 76*f;* and adjustable length straps 27*a* and 27*b* removably coupling outer shell 76*a* to helmet side sections 22*a* and 22*b*. The hood is layered between outer shell 76*a* and inner facepiece 76*b*. Components 76*c*, 76*d*, 76*e* and 76*f* pass through holes in the hood and are secured to inner facepiece 76*b*, effectively clamping the hood between facepiece 76*b* and outer shell 76*a*. Hose 76*c* and the tubular portion of valve 76*d* may be secured to facepiece 76*b* with threaded nuts 76*g* and 76*h*, for example. Any openings between the holes and the components are filled with an appropriate sealant.

A pair of earphones 78 are placed inside the hood, whereby the hood provides increased attenuation of external ambient noise allowing improved communication. The earphones have a communications cable 78*a* which passes through a hole in the hood. Any opening between the hole and cable 78*a* is filled with an appropriate sealant. Further down, hood 70 has a lower edge 70*a* near which is attached a neck dam 70*b*. Optionally, a shoulder shroud 70*c* may be attached onto lower edge 70*a*. Neck dam 70*b* is an air barrier preventing exchange of air between the head cavity and the atmosphere or the lower portion of a flight suit or other garment. A dump valve 70*d* is located above neck dam 70*b* for releasing excess pressure from within the head cavity. Shroud 70*c* may be attached to the flight suit or other garment with a slide fastener or simply tucked inside. Hood 70 is made from a chemically resistant and biologically resistant material, like rubber or butyl rubber. The hood is molded to the contours of the interior of the helmet.

Figure 3B:
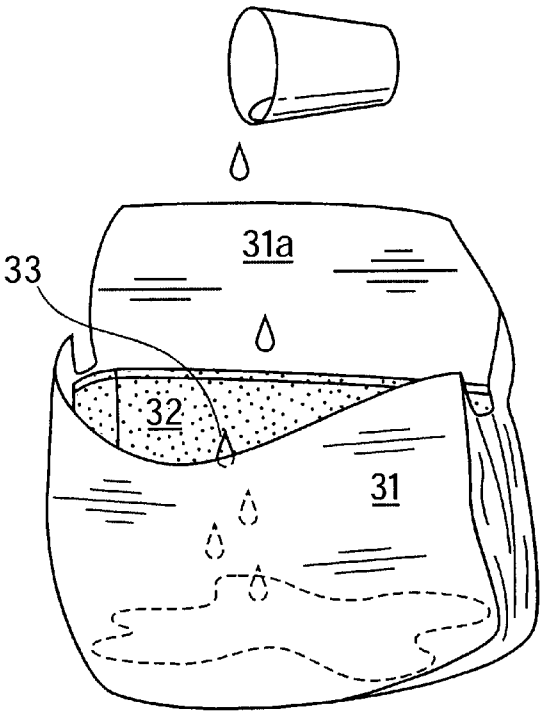
FIG. 3B is a front side elevational view of the brow pad illustrating a foaming operation for custom fitting the brow pad to the wearer's forehead.
Figure 3A:
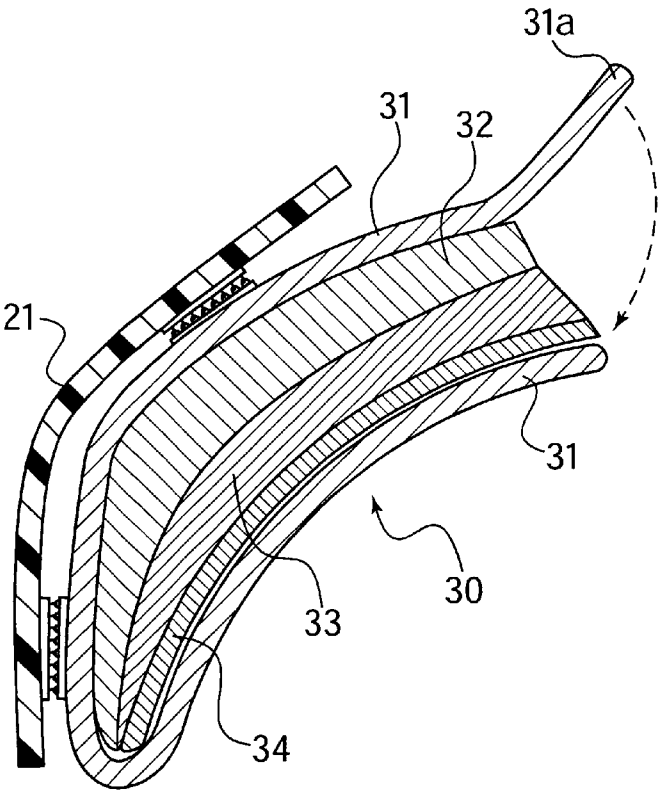
FIG. 3A is an enlarged view of the front brow pad taken from FIG. 2A.

Referring now to FIGS. 3A and 3B, brow pad 30 is shown comprising an outer pouch 31 equipped with a closeable flap 31*a*. Pouch 31 is removably affixed to the inner surface of forehead dome 21, for example, by hook and loop fasteners or other suitable means. Pouch 31 is made from a material which has characteristics of durability and comfort when contacting the wearer's skin, e.g. leather or other suitable materials. Within the pouch there is an outer liner 32 made of an impact absorbing material, for example, polystyrene, which conforms to the interior of forehead dome 21. There is also an inner layer 34 made of compressible, comfort material, for example, foam rubber. Once nape panel 40 and crown pad 50 are adjusted to the proper exit pupil, the interior of pouch 31 is filled with a liquid foaming agent which expands and solidifies to conform to the contours of the wearer's forehead and the outer liner 32. As can be seen in FIG. 3B an expandable foam may be used wherein the foaming agent in liquid form 33 is injected or poured into the interior of pouch 31 and expands to fill the cavity. A minimally exothermic polyurethane foam having a relatively fast rise time may be used, for example, foams made from polyether polyol resin combine with pre-reacted diphenylmethane diisocyanate.

Figure 3C:
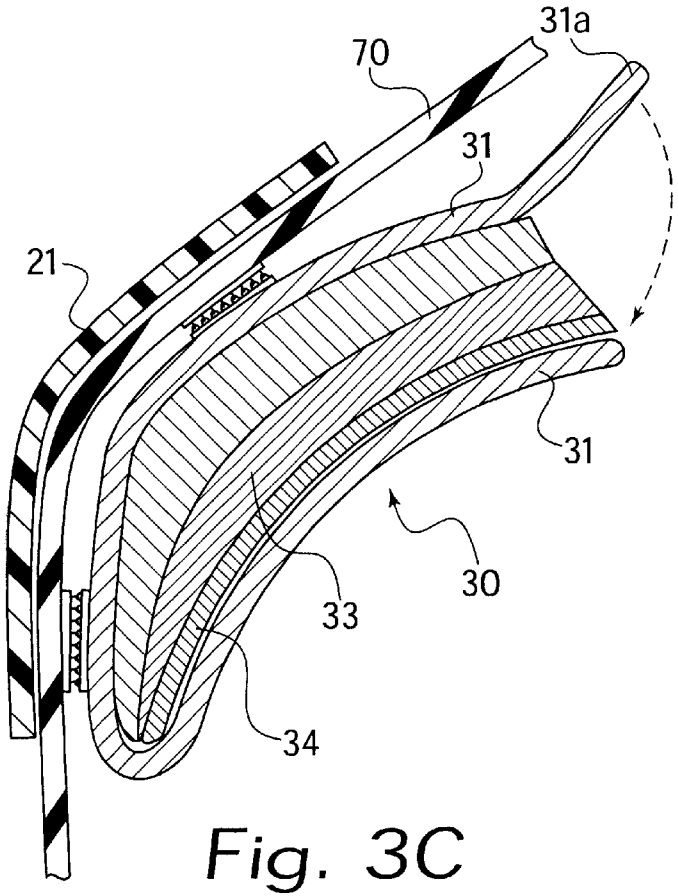
FIG. 3C is an enlarged view similar to FIG. 3A showing the protective hood in relation to the brow pad.

In FIG. 3C, protective hood 70 is shown between forehead dome 21 and brow pad 30. Brow pad 30 is first fitted, as described above, in the absence of hood 70. Brow pad 30 is then placed inside hood 70 and attached with a hook and loop fastener to the hood 70 instead of forehead dome 21.

Figure 4C:
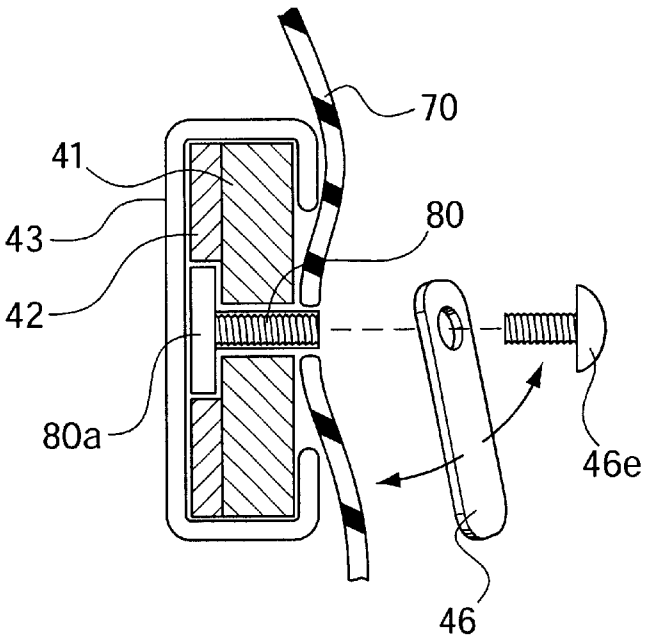
FIG. 4C is an enlarged view similar to FIG. 4A showing the protective hood in relation to the pivotal connection of the support panels.
Figure 4A:
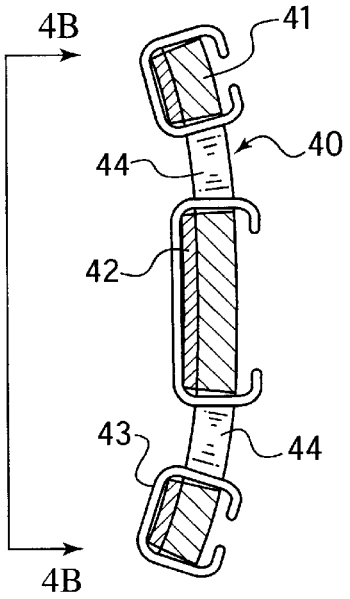
FIG. 4A is an enlarged view of the nape strap taken from FIG. 2A.
Figure 4B:
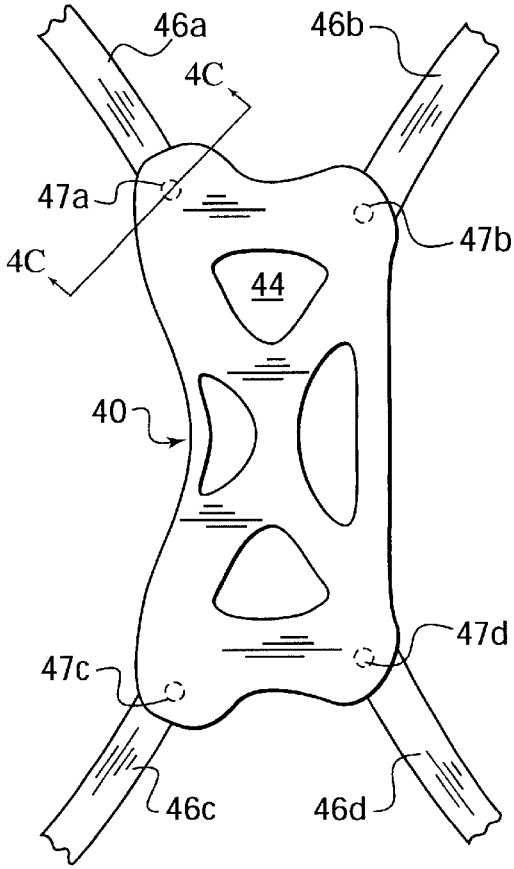
FIG. 4B is a front side elevational view of the nape strap.

In FIG. 4A, nape panel 40 is shown comprising a semi-rigid frame 41 made, for example, from a composite resin. Very thin, flexible composite resin layers are laminated together resulting in lightweight, yieldable panels. Interior of frame 41 is a comfort layer 42 made from a compressible material, for example, foam rubber. Further interior is a cover layer 43 made from a comfortable, durable material, for example, leather. Cover layer 43 holds comfort layer 42 in place by extending through apertures 44 or around the outer perimeter where its edges are adhered on the exterior side of frame 41. FIG. 4B shows apertures 44 along with straps 46*a*, 46*b*, 46*c* and 46*d* which are attached respectively to four quadrants of nape panel 40 via pivoting connection points 47*a*, 47*b*, 47*c* and 47*d*.

FIG. 4C shows the pivotal connection between the support panels and their straps in detail. A portion of comfort layer 42 is removed and a hole is formed in frame 41 to accommodate a threaded female post 80 which terminates at its left side in a retention plate 80*a*. Hood material 70 is fitted around post 80 with any openings being filled by an appropriate sealant. Strap 46 is pivotally connected to post 80 via screw 46*e*. Hence, the pivotal connections for both support panels are maintained with the hood material completely sealing the support panels therein. The benefit of this configuration is that the support panels, as well as the brow pad, serve to lift the hood material off the wearer's head providing greater comfort. This configuration also maintains the contact surfaces between the brow pad and the wearer as well as between the support panels and the wearer. Therefore, the wearer's head can be completely sealed against the environment while maintaining the reproducible alignment of the eyebox, which is critical for HMD systems.

Referring again to FIG. 2B, this lifting of the hood results in a gap 50*c* between webbing strips 50*a* and 50*b* of the support panel or a space 50*d* adjacent the support panel. A duct 90 having an exhaust vent 90*a* directed toward gap 50*c* or space 50*d* is provided. Duct 90 extends through a hole in the hood. Any spaces around the hole are filled with an appropriate sealant. Ventilating air is provided to duct 90 to cool the wearer's head.

Figure 5:
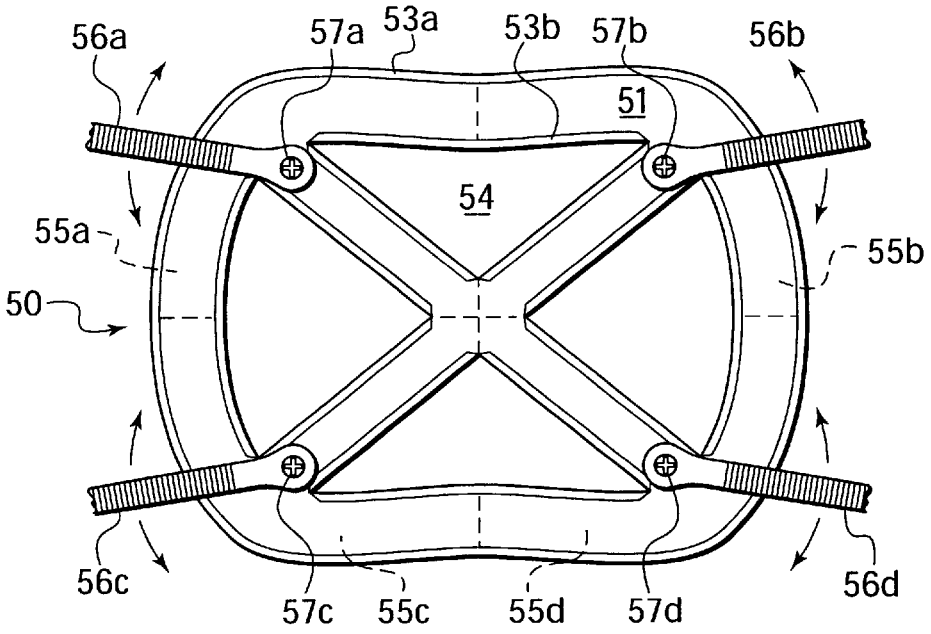
FIG. 5 is a top plan view of the crown pad taken along the line 5—5 from FIG. 2A.

As can be seen in FIG. 5 crown pad 50 has a similar construction to nape panel 40 including a semi-rigid frame 51, a comfort layer similar to 42 and a cover layer similar to 43. As can be seen from this top plan view, the cover layer has edges 53*a* and 53*b* which extend through apertures 54 before being adhered on the exterior surface of frame 51. Each of the quadrants 55*a*, 55*b*, 55*c* and 55*d* includes a strap 56*a*, 56*b*, 56*c* and 56*d* pivotally attached to frame 51 via screws 57*a*, 57*b*, 57*c* and 57*d*. The apertures create web-like strips in panel 40 and pad 50 that extend from the adjacent quadrants out to the strap connection points. This web-like configuration allows each quadrant to conform to the contours of the wearer's crown and nape as the straps bend to extend through the side panel slots in the inner helmet. In other words, the straps and the connection points of FIGS. 4B and 5 have a further independent degree of flexibility into and out of the page.

Figure 6A:
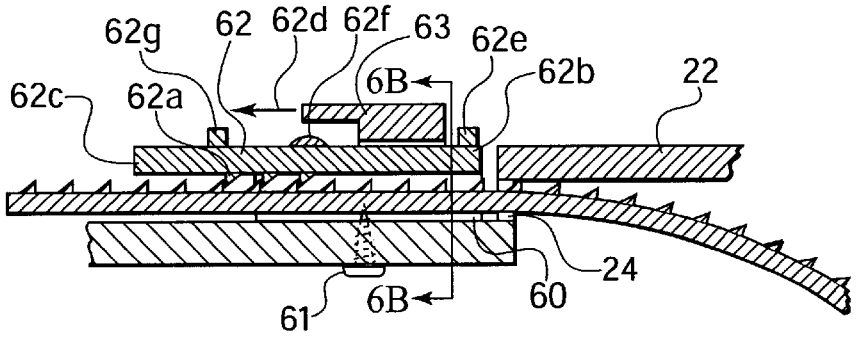
FIG. 6A is a cross-sectional view of a retention clip engaging a strap taken along the line 6*a*—6*a* from FIG. 2.
Figure 6B:
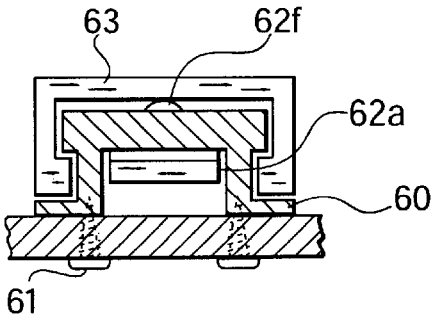
FIG. 6B is a further view cross-sectional view of the retention clip taken along the line 6B—6B from FIG. 6A.

FIG. 6A shows an exemplary bendable, plastic strap extending initially through a side panel slot 24 formed within side panel 22*a* or 22*b* and further through clip frame 60 made of rugged plastic. Mounting screws 61 secure clip frame 60 to the exterior of side panel 22. Extending outwardly from clip frame 60 is a cantilevered retention arm 62 having a fixed end 62*b* and a free end 62*c* with downwardly extending wedges 62*a* therebetween. Locking element 63, as can be seen more clearly in FIG. 6B is slideably mounted to clip frame 60. Locking element 63 is slideable in direction 62*d* from a position adjacent rear stop 62*e*, over detent 62*f*, to a position adjacent front stop 62*g*. Ordinarily the free end 62*c* of cantilevered retention arm 62 is free to rise upwardly as wedges 62*a* ratchet over corresponding wedges 58 on the strap. Once the final adjusted position is obtained, locking element 63 is slid to its left most locking position whereby the free end 62*c* is prohibited from riding upwardly to lock the strap in position. In a practical embodiment, wedges 58 on the strap and arm were spaced 2 mm apart.

FIG. 2A shows a positioning fixture 29 with a reference point 29*a*. Positioning fixture 29 is dimensioned and configured to align reference point 29*a* on the exact line of sight of the ultimate display. The crown pad strips and nape panel straps are adjusted in 2 mm increments to locate reference point 29*a* directly in front of the wearer's eyes at a predetermined distance. If a strap is inserted too far through clip 60, free end 62*c* is raised and the strap is retracted. Once aligned, locking elements 63 are moved to their locking positions over free ends 62*c*. While maintaining the aligned position on the wearer's head, brow pad 30 is filled with the appropriate amount of foaming agent. The resulting foam 33 expands to fill the gap and press the head firmly against nape panel 40. Brow pad 30 and nape panel 40 are generally diametrically opposed. Accordingly, the inner helmet may be easily donned and doffed while simultaneously reestablishing the exact eyebox alignment every time. Upon tightening chin strap 19, the inner helmet assembly becomes locked in position on the head. Centrifuge testing was performed with head movements up to 4 G and forwardly-positioned stationery head positioning up to 9 G. Overall the approximately 4½ lbs. complete inner/outer helmet was displaced a maximum of 4 mm with the average for 10 aircrew between 1.5 and 3 mm.

It will be seen that we have provided a lightweight inner helmet with conformable panels and a complementary contoured pad that can be easily custom fitted to a large population. The helmet fitting assembly effectively distributes weight and resists displacement forces by locking the assembly to the head over large surface areas. The positive lock retention system and molded brow pad insure reproducible alignment to the eyebox thereby meeting critical requirements for HMD utilization.

It will be understood that certain features and subcombinations are of utility and may be employed without reference to other features and subcombinations. This is contemplated by and is within the scope of the claims. It is further obvious that various changes may be made in details within the scope of the claims without departing from the spirit of the invention. It is, therefore, to be understood that the invention is not to be limited to the specific details shown and described.

What is claimed is:

1. A system for adjusting an enclosed support panel comprising:

a helmet having an interior;

a protective hood lining said interior;

a support panel disposed within said protective hood; and a custom fitting system disposed outside of said protective hood and operationally coupled to said support panel through said protective hood.

2. The system of claim 1, wherein said custom fitting system adjusts the relative position between said support panel and said helmet.

3. The system of claim 1, wherein said custom fitting system is pivotably connected to said support panel and wherein said protective hood is sealed around the pivotal connection.

4. The system of claim 3, wherein said custom fitting system comprises:

straps pivotally connected to said support panel; and strap retaining clips mounted to said helmet.

5. The system of claim 1, wherein said support panel comprises a nape panel.

6. The system of claim 5, wherein said custom fitting system adjusts the front-to-back position of said nape panel relative to said helmet.

7. The system of claim 1, further comprising a brow pad disposed within said protective hood.

8. The system of claim 1, wherein said support panel comprises a crown panel.

9. The system of claim 8, wherein said custom fitting system adjusts the height of said crown panel relative to said helmet.

10. The system of claim 8, wherein said crown panel comprises webbing strips with a gap formed therebetween.

11. The system of claim 10, comprising a crown duct equipped with an exhaust vent directed toward the gap.

12. The system of claim 11, wherein said hood is sealed around said crown duct.

13. The system of claim 8, wherein said crown panel creates a space between said protective hood and a wearer's head.

14. The system of claim 13, comprising a crown duct equipped with an exhaust vent directed toward the space.

15. The system of claim 14, wherein said hood is sealed around said crown duct.

16. The system of claim 1, wherein said helmet includes a visor having an interior surface and a periphery and said protective hood is sealed to said visor periphery.

17. The system of claim 16, wherein said visor includes a visor duct along at least a portion of said visor periphery, and wherein said visor duct is equipped with vent holes directed toward the interior surface of said visor.

18. The system of claim 16, further comprising a respiration system including a stiff outer shell equipped with a breathing air supply hose and an exhalation valve, wherein said outer shell overlies a portion of said protective hood disposed below said visor.

19. The system of claim 18, wherein said protective hood seals around said breathing air supply hole and said exhalation valve.

20. The system of claim 1, further comprising a respiration system including a stiff outer shell equipped with a breathing air supply hose and an exhalation valve, wherein said outer shell overlies a portion of said protective hood with said protective hood sealing around said breathing air supply hose and said exhalation valve.

21. The system of claim 20, wherein said respiration system additionally includes an adjustable length strap removably coupled between said outer shell and said helmet.

22. The system of claim 20, wherein said outer shell is equipped with a microphone cable, wherein said protective hood seals around said microphone cable.

23. The system of claim 20, wherein said outer shell is equipped with a drink tube, wherein said protective hood seals around said drink tube.

24. The system of claim 1, wherein said helmet includes earphones having communications cables, wherein said earphones are disposed within said hood and said hood is sealed around said communications cables.

25. The system of claim 1, further comprising a respiration system including a stiff outer shell and an inner facepiece adapted to enclose a mouth and nose of a wearer, wherein said stiff outer shell and said inner facepiece sandwich a portion of said protective hood therebetween.

26. The system of claim 25, wherein said respiration system includes a breathing air supply hose and an exhalation valve, wherein said protective hood seals around said breathing air supply hose and said exhalation valve.

27. The system of claim 1, wherein said protective hood has a lower edge.

28. The system of claim 27, comprising an elastic neck dam connected near said lower edge of said protective hood.

29. The system of claim 27, comprising a shoulder shroud connected to said lower edge of said protective hood.

30. The system of claim 1, wherein said protective hood is made from a chemical resistant and biological resistant material that is molded to the shape of the helmet interior.

31. A fitting assembly for a helmet comprising:

an inner helmet positionable in a fore and aft direction, and for placement within said helmet, and including interiorly a front forehead dome and side sections;

a rear panel adapted to contact the wearer's nape and means coupling said rear panel to said side sections for adjustably positioning said inner helmet in the fore and aft direction;

a contoured pad adapted to support the dome on the wearer's forehead; and a protective hood secured to and lining the interior of said inner helmet.

32. The assembly of claim 31, wherein said contoured pad comprises a primary layer molded to the contours of the wearer's forehead.

33. The assembly of claim 32, wherein said primary layer comprises an expanding foam compound having an initial liquid state and a final, cured solid state.

34. The assembly of claim 33, wherein said compound is introduced in the initial liquid state into a gap formed between said dome and the wearer's forehead and wherein said compound expands to substantially occupy the gap in the final, cured solid state.

35. The assembly of claim 32, further comprising an inner layer of compressible material disposed between said primary layer and the wearer's forehead.

36. The assembly of claim 35, wherein said contoured pad further comprises an outer impact absorbing layer disposed between said primary layer and said dome.

37. The assembly of claim 36, wherein said inner and outer layers cooperatively form a receptacle for containing said primary layer.

38. The assembly of claim 36, wherein said contoured pad further comprises a pouch made of a material adapted for skin contact, wherein said pouch encases said primary layer, said inner layer and said outer layer.

39. The assembly of claim 31, wherein said coupling means comprises straps on said rear panel and retention clips on said inner helmet.

40. The assembly of claim 39, wherein said rear panel straps are pivotally connected to said rear panel.

41. The assembly of claim 40, wherein said rear panel comprises a semi-rigid material.

42. The assembly of claim 41, wherein said rear panel straps pivot to engage said clips and upon tightening, said rear panel straps are adapted to flex said rear panel to the profile of the user's nape.

43. The assembly of claim 31, further comprising a chin strap attached to lower regions of said side sections, wherein said chin strap and said contoured pad and said rear panel form a three-point restraint which cooperatively resists forward rotation of the helmet.

44. The assembly of claim 31, further comprising a breathing mask attached to lower regions of said side sections, wherein said breathing mask and said contoured pad and said rear panel form a three-point restraint which cooperatively resists forward rotation of the helmet.

45. The assembly of claim 31, wherein said rear panel is disposed within said protective hood.

46. The assembly of claim 31, wherein said contoured pad is disposed within said protective hood.

47. The assembly of claim 31, wherein said rear panel coupling means is disposed outside said protective hood.

48. The assembly of claim 31, further comprising:

a crown pad adapted to contact the wearer's crown, wherein said inner helmet is additionally positionable in a vertical direction; and means coupling said crown pad to said side sections for adjustably positioning said inner helmet in the vertical direction.

49. The assembly of claim 48, wherein said coupling means comprises straps on said crown pad and retention clips on said inner helmet.

50. The assembly of claim 49, wherein said crown pad straps are pivotally connected to said crown pad.

51. The assembly of claim 50, wherein said crown pad is made of a semi-rigid material.

52. The assembly of claim 51, wherein said crown pad straps pivot to engage said clips and upon tightening, said crown pad straps are adapted to flex said crown pad to the profile of the user's crown.

53. The assembly of claim 48, wherein said crown pad is disposed within said protective hood.

54. The assembly of claim 48, wherein said crown pad coupling means is disposed outside of said protective hood.

* * * * *

UNITED STATES PATENT AND TRADEMARK OFFICE

CERTIFICATE OF CORRECTION

PATENT NO. : 6,401,259 B1
APPLICATION NO. : 09/729119
DATED : June 11, 2002
INVENTOR(S) : William Lewis Epperson, Franci J. Kuna and Robert Henry Nattress It is certified that error appears in the above-identified patent and that said Letters Patent is hereby corrected as shown below:

In column 1, line 3, insert the following:

--STATEMENT OF GOVERNMENT INTEREST

The U.S. Government has a paid-up license in this invention and the right in limited circumstances to require the patent owner to license others on reasonable terms as provided for by the terms of Contract Number N68335-95-C-0008 awarded by the naval Air Warfare Center – Aircraft Division.--

Signed and Sealed this

Sixteenth Day of February, 2010

David J. Kappos

David J. Kappos
*Director of the United States Patent and Trademark Office*